US005363866A

United States Patent [19]

Egger

[11] Patent Number: 5,363,866

[45] Date of Patent: Nov. 15, 1994

[54] METHOD OF CLEANING CONTAINERS, A RINSING ASSEMBLY AND AN APPARATUS FOR CLEANING CONTAINERS

[75] Inventor: Walter C. Egger, Weggis, Switzerland

[73] Assignee: VTZ Engineering & Services AG, Steinhausen, Switzerland

[21] Appl. No.: 81,429

[22] Filed: Jun. 22, 1993

[30] Foreign Application Priority Data

Jun. 24, 1992 [DE] Germany ..... 4220568

[51] Int. Cl.[5] ..... B08B 3/02

[52] U.S. Cl. ..... 134/45; 134/167 R; 134/131; 134/171

[58] Field of Search ..... 134/62, 167 R, 172, 134/45, 171, 131

[56] References Cited

U.S. PATENT DOCUMENTS

| | | | |
|---|---|---|---|
| 1,904,685 | 4/1933 | Gruetter | 134/167 R |
| 1,910,958 | 5/1933 | Meyer et al. | 134/62 |
| 2,004,410 | 6/1935 | Houch et al. | 134/62 |
| 2,364,971 | 12/1944 | Hageline | 134/167 R |
| 2,418,003 | 3/1947 | Alling et al. | 134/62 X |
| 5,092,356 | 3/1992 | Grot | 134/167 R |

*Primary Examiner*—Frankie L. Stinson
*Attorney, Agent, or Firm*—Tarolli, Sundheim & Covell

[57] ABSTRACT

The invention provides a method of cleaning containers, particularly bottles, in which the bottles to be cleaned are continuously moved in uniform spatial orientation past a row of jet nozzles ejecting a cleaning agent. Each time a bottle passes a particular jet nozzle, that jet nozzle is aligned with the bottle mouth during a certain portion of the path of motion of the bottle. This follower motion is positively effected by means of a catch member provided at the jet nozzle. The advantage of the method according to the invention lies in the fact that each jet nozzle is aligned with the bottle mouth during a relatively long period of time and, thus, is able to clean the bottle more effectively. The jet nozzle can be mounted at the end of a swiveling lever arm member being under the influence of a spring member forcing the lever member back to an initial position. A cleaning apparatus can provide a row of such jet nozzles which are swiveling independently from each other. As a conveying means for the bottles, a drag chain conveyor can be provided since the mutual distance of the bottles to be conveyed past the jet nozzles is not critical.

28 Claims, 10 Drawing Sheets

12
10
31
32
34
33
35
30

21

METHOD OF CLEANING CONTAINERS, A RINSING ASSEMBLY AND AN APPARATUS FOR CLEANING CONTAINERS

FIELD OF THE INVENTION

The present invention refers to a method of cleaning containers having an opening, particularly bottles, by spraying out and/or blowing out the interior of the containers by means of a jet of a fluid and/or gaseous cleaning agent, a rinsing assembly for cleaning containers having an opening, particularly bottles, which are conveyed along a path of motion extending in front of said rinsing assembly, by spraying out and/or blowing out the containers by means of a jet of a fluid and/or gaseous cleaning agent, and an apparatus for cleaning containers having an opening, particularly bottles, by spraying out and/or blowing out the interior of the containers by means of a jet of a fluid and/or gaseous cleaning agent.

Apparatuses for cleaning bottles, so-called rinsers, are known in the art in a variety of embodiments. Usually, they comprise a continuously running conveying means, and a feeding means for feeding bottles in an upright position to the conveying means such that the bottles to be cleaned are arranged in a row on the conveying means. In the conveying means, the bottles are turned by 180° such that the opening of the bottles is directed downwards and the bottles are transported through a rinsing assembly and a dripping assembly. Finally, the cleaned bottles are turned by 180° again in their upright position and removed from the conveyor means to a discharging means. Thereby, for this purpose, different types of conveyor means are usable, depending on the particular rinsing assembly.

According to a known bottle rinsing method, the bottles are moved in front of immovable jet nozzles having a stationary position. The jet nozzles, thereby, are arranged in a row along the path of motion of the bottles. It is common practice to continuously operate these jet nozzles during the period in which the bottles move past the nozzles, in other words, the jet nozzles continuously eject a jet of cleaning agent. The openings of the bottles to be cleaned which are moved past the jet nozzles, however, are aligned with the jet nozzles only during a relatively short interval. The result is, that the cleaning period, i.e. the effective time during which the cleaning agent jet hits the interior of the bottle, is relatively short and the efficiency of this cleaning method is quite low. During the time which passes until the opening of the subsequent bottle in the row is aligned with the jet ejected from the above mentioned jet nozzle, the cleaning agent is needlessly sprayed into a space between two adjacent bottles or to the outside of a bottle. Thus, only a small fraction of the cleaning agent supplied to the jet nozzles is effectively used for cleaning the bottles. Under these circumstances, the consumption of cleaning agent is relatively high and a great number of jet nozzles has to be provided for a sufficient cleaning of the bottles. A design with stationary and continuously operating jet nozzles usually is connected with a considerably high expenditure, not only as far as the consumption of cleaning agent is concerned, but also with regard to the required high number of jet nozzles. The same is correspondingly true if the bottles have to be blown out with a gaseous cleaning agent. Last but not least, such a design cannot be used if it is of importance that the bottles to be cleaned remain dry at their outer side.

Another known design comprises stationary jet nozzles each of which is provided with a valve member to control the supply of cleaning agent to the jet nozzle. In other words, in this design, the jet nozzles are operating only during a predetermined time interval during which the opening of a bottle is aligned with the jet of cleaning agent ejected by the nozzle. Between these intervals, the supply of cleaning agent to the jet nozzle is interrupted. With this measure, the consumption of cleaning agent, however, may be reduced and the efficiency may be increased. On the other side, the expenditure required by the plurality of valves and their control is relatively high. Further disadvantages are that the operational life time of the valves is quite low due to the high switching frequency, and that the plurality of valves and the control means are a potential source of trouble. Finally, it must be noted that, under the given circumstances, the achievable bottle cleaning cycles per hour is quite low.

For transporting bottles in a rinser of the above mentioned kind, i.e. in a rinser having stationary jet nozzles without controlled valves, a conveying means can be provided e.g. in the manner of a drag chain conveyor, since there is no necessity to convey the bottles in a predefined regular mutual distance past the rinsing assembly. The only requirement is that each bottle has a uniform predetermined spatial orientation at each position of the path of motion. On the one hand, in order to facilitate the handling of the bottles, it is favorable that all bottles leave the conveyor means in a uniform spatial orientation in order to facilitate the further conveying thereof. On the other hand, the bottles must be positioned with regard to the jet nozzles in a well defined position in order to provide for an optimal cleaning effect. All these requirements can be fulfilled by a drag chain conveyor. Furthermore, the mutual distance between the bottles can easily be adjusted and adapted to the special requirements by adjusting the conveying speed with regard to the speed at which the bottles are delivered to the drag chain conveyor.

These conditions are different in the case of a rinser assembly with jet nozzles which are moved in synchronization with the conveyor means for the bottles along a certain path of motion of the bottles in order to ensure that the momentarily operating jet nozzles are exactly aligned with the related bottle mouth. Bottle cleaning machines and rinsing assemblies of this kind are known in the art in different embodiments, i.e. such with stationary positioned movable jet nozzles (cf. German Published Patent Application No. 26 07 077) as well as such with movable position (cf. German Published Patent Application No. 33 01 525). In these known embodiments, the synchronism of the movement of the jet nozzles is related to the conveying means for the bottles. For this reasons, conveyor means having well defined receiving places for the bottles are required such that the bottles arrive in the operational area of the equidistantly arranged jet nozzles in a uniform mutual distance.

The bottle cleaning apparatus according to the German Published Patent Application No. 33 01 525 comprises a rinsing assembly with a plurality of jet nozzles which are arranged in a circular configuration on a revolving table member below a semicircular portion of the path of motion of the conveying means whereby the revolving table is mechanically coupled to the conveying means and synchronously rotates therewith. If a suitable control means is provided which ensures that all jet nozzles not located in the region of the aforementioned semicircular portion of the path of motion of the conveying means, i.e. all jet nozzles which are not operative, are shut off until they enter into the region of the rinsing assembly, such a design allows to reach evidently a much higher efficiency as far as the consumption of cleaning agent is concerned than with a design with stationary located jet nozzles. In the above mentioned publication, further disclosed is a design in which the jet nozzles additionally rotate around an axis running perpendicular to the plane of the revolving table and have an inclined position with reference to the central axis of the bottles, with the result that the jet of cleaning agent does not centrally hit the interior of the bottle, but is directed against the inner walls of the bottle; in this manner, the interior of the bottle is sprayed out with a rotating motion of the jet of cleaning agent.

A fundamental disadvantage of a bottle cleaning method making use of a rigidly arranged row of synchronously moved jet nozzles is that the bottles must have a uniform mutual distance during its path of motion past the rinsing assembly, said mutual distance having to correspond to the mutual distance of the jet nozzles. As already mentioned, this calls for a conveying means having well defined receiving places for the bottles, e.g. a chain conveyor which comprises receiving members for each bottle to be cleaned which are arranged in a uniform mutual distance. For instance, these bottle receiving members comprise a disk-shaped supporting member and an annular supporting member, whereby each bottle, after having been fed to the conveyor means, stands upright on a disk-shaped supporting member and later, after having been turned over by 180°, is held by the annular supporting member.

A further essential prerequisite for the trouble free operation of such a conveyor assembly is that suitable feeding and discharge means are available. Thereby, at the feeding side of the conveyor, means have to be provided to feed the bottles to the above mentioned supporting members, and at the discharge side of the conveyor, means must be provided to take the bottles out of the above mentioned supporting members. Such feeding and taking out means usually comprise expensive grip members adapted to the particular shape of the bottles to be handled which are subjected to high wear and, thereby, often cause troubles. Furthermore, an operating person must be present to supervise the operation of the machine and to exchange the grip members if other bottles have to be handled. Thus, the total expenditure for the erection and the operation of the conveyor means and the associated feeding and discharging means is very high. An optimal cleaning effect and an optimal efficiency, as far as the consumption of the cleaning agent is concerned, may be achieved, in this case, only by providing an expensive complicated machinery.

A further disadvantage associated with this known design must be mentioned: The space economy is not very good since the rinsing assembly located in the region of a curved portion of the conveyor means extends only over a half circle of the path of motion of the containers. The linear portions of the path of motion of the containers cannot be used by the rinsing assembly. The result is that the rinsing assembly is spatially limited to a fraction of the entire machinery volume. An essential part of the entire machinery volume is spent for the quite large conveyor means, and additional space is required for the drying portion of the conveyor.

Even if the jet nozzles move in synchronism with the bottles, it is not always made sure that the bottle mouth is optimally aligned with the jet nozzle when the bottles are moved past the rinsing assembly. Difficulties in this respect can arise due to tolerances in the dimension of the bottles. Under these circumstances, a precisely defined position of the bottles in the above mentioned supporting members is not automatically ensured and can be reached only if the supporting members additionally comprise further means for the compensation of bottle dimension tolerances. Thus, deviations from a well defined position can lead to the undesired effect, in spite of a synchronized operation of the bottle conveyor and the rinsing assembly, that the jet ejected by the jet nozzles is not centrally aligned with the bottle mouth and at least partially hits the bottle head where the jet can be deflected.

OBJECTS OF THE INVENTION

It is an object of the present invention to provide a method of cleaning containers having an opening, particularly bottles, by spraying out and/or blowing out the interior of the containers by means of a jet of a fluid and/or gaseous cleaning agent, which is free of the disadvantages mentioned herein above.

It is a further object of the invention to provide a method of cleaning containers having an opening, particularly bottles, by spraying out and/or blowing out the interior of the containers by means of a jet of a fluid and/or gaseous cleaning agent, which can be performed by means of a rinsing assembly and a rinsing apparatus, respectively, which are of much simpler design and which require a much lower expenditure, particularly by using conveyor means of simpler design for moving the containers to be cleaned.

It is a further object of the present invention to provide a method of cleaning containers having an opening, particularly bottles, by spraying out and/or blowing out the interior of the containers by means of a jet of a fluid and/or gaseous cleaning agent, in which the conveyor means require less expensive and trouble free operating feeding and discharging means as a known apparatus having jet nozzles synchronously moved with the containers.

It is a still further object of the present invention to provide a method of cleaning containers having an opening, particularly bottles, by spraying out and/or blowing out the interior of the containers by means of a jet of a fluid and/or gaseous cleaning agent, which has a high efficiency and an optimized consumption of cleaning agent for the containers, particularly a higher efficiency and an optimized consumption of cleaning agent than a method operating with stationary jet nozzles.

SUMMARY OF THE INVENTION

In order to meet these and other objects, the invention provides, according to a first aspect, a method of cleaning containers having an opening, particularly bottles, by spraying out and/or blowing out the interior of the containers by means of a jet of a fluid and/or gaseous cleaning agent. According to the invention the containers are arranged in a row with uniform spatial orientation, and at least one jet nozzle mounted to be movable from a first initial position to a second final position and back to the first initial position is provided, whereby the jet nozzle is connected to a supply of cleaning agent.

Then the row of containers is conveyed with uniform speed along a path extending in front of the jet nozzle in an orientation of the containers in which the opening of the containers face the jet nozzle. Thereafter, the opening of the first container in the row with is aligned with the outlet of the jet nozzle and the jet nozzle is moved from the first initial position to the second final position with a speed corresponding to the conveying speed of the first container in the row by positive engagement of the first container with the jet nozzle while a jet of cleaning agent escapes from the jet nozzle to clean the interior of the first container.

Now, the jet nozzle is moved back from its second final position into its first initial position, and the cleaning steps (last three steps) are repeated for all subsequent containers in the row of containers.

In this manner, a real synchronized operation of the jet nozzle and the opening of the container is phasewisely realized, in contrary to the known solutions, in which the synchronization is related to the conveying means and the supporting means for the containers, respectively, and not to the openings of the containers themselves.

The main disadvantage associated with the method according to the present invention lies in the fact that, with a stationary arranged movable jet nozzle, the operating phase of the jet nozzle is increased to a higher time period, resulting in a higher degree of utilization of the cleaning agent. In practice, compared to a method with rigid, immovable jet nozzles, an increase in the degree of utilization of the cleaning agent by a factor of five may be achieved. Due to the fact that the opening of the container is always precisely aligned with the jet nozzle, a higher efficiency in the cleaning operation results.

The method of the invention, however, can also be realized in a design with jet nozzles which move in synchronization with the containers. The additional follower motion of the jet nozzle serves, in this case, for the compensation of possible deviations as far as the position of the container with regard to the position of the jet nozzle is concerned. This means that it is not necessary to provide for an absolutely perfect in-phase position of the container to be cleaned and the associated jet nozzle, both of them being moved with more or less the same speed, in order to ensure a trouble free operation of the rinser. The result is that simpler conveying means can be used which can fulfill the requirement with regard to the in-phase position only more or less.

The movable jet nozzle can be operated continuously, even if it is stationary mounted; in other words, an interruption of the cleaning agent supply between two cleaning operations is not necessary if it is ensured that the time period between two cleaning operations is as short as possible and that the jet nozzle is moved back into its initial position as quickly as possible. Preferably, the backward motion of the jet nozzle should be higher than the follower motion, particularly much higher. Thereby, the consumption of uselessly ejected cleaning agent can be kept within close limits. In any case, thereby, the degree of utilization of the cleaning agent is a multiple as the one in the case of stationary immovable jet nozzles. Finally, it must be mentioned that there is no need of valve means and associated control means for controlling the supply of cleaning agent to the jet nozzles.

Preferably, according to a preferred embodiment of the method of the invention, the jet nozzle performs a swiveling motion when it is moved from its first initial position to its second final position such that the jet of cleaning agent escaping from the jet nozzle initially hits a side wall of the interior of the container aligned therewith, then covers the bottom of the interior of the container and finally hits the opposite side wall of the interior of the container.

According to a second aspect of the invention, there is provided a rinsing assembly for cleaning containers having an opening, particularly bottles, which are conveyed along a path of motion extending in front of the rinsing assembly, by spraying out and/or blowing out the containers by means of a jet of a fluid and/or gaseous cleaning agent. The rinsing assembly comprises at least one jet nozzle mounted to be movable from a first initial position to a second final position and back to the first initial position, and connected to a supply of cleaning agent, the path of motion of the jet nozzle from its first initial position to its second final position and back to its first initial position extending along the path of motion of the containers to be cleaned.

The jet nozzle is relatively movable with regard to the motion of the containers and it provided with catch means adapted to come into engagement with a portion of the containers during their movement along their path of motion and thereby positively aligning the jet of cleaning fluid escaping from the jet nozzle with the opening of the containers during a portion of the path of motion of the containers.

Due to the movability of the jet nozzle and due to the positive follower motion effected by the container to be cleaned, the time period of operation is increased as compared with a stationary immovable jet nozzle. The result is that the overall efficiency of the rinsing assembly is increased and the consumption of cleaning agent reduced.

The jet nozzle can be mounted in a stationary position or in a movable position. In the latter case, the movable position runs on a path extending parallel to the path of motion of the containers to be cleaned and with a speed which is adapted to the conveying speed of the containers.

The jet nozzle can be provided with a catch member movable between its first initial position and its second final position whereby it protrudes into the path of motion of the containers during his movement from its first to its second position. Preferably the path of motion of the catch member and the path of motion of the containers diverge so that the catch members automatically leaves the path of motion of the container as soon as the cleaning phase has come to an end. For this purpose, the path of motion of the catch member can extend along a circular arc which intersects or touches the path of motion of the containers. The path of motion of the catch member, however, may also extend parallel to the linear or curved path of motion of the containers, if means are provided which effect a movement of the catch member out of the path of motion of the containers as soon as the cleaning phase is terminated.

According to a preferred embodiment, the jet nozzle is mounted at the free end of a swiveling single arm lever member, whereby a spring means is provided to force the lever member into its first initial position. Thereby, the lever member comes into engagement with a portion of a container conveyed along the jet nozzle to be forced to follow the container along a portion of its path of motion against the force of the spring means. The jet nozzle remains thereby in a position aligned with the opening of the relating container as the lever member is in engagement with the portion of the related container.

Particularly, the lever member is constituted by a rigid tube member, one end thereof being pivotally mounted and said tube member being adapted to supply cleaning agent to the jet nozzle mounted on its free end. The rinsing device further comprises a stop member and a spring means forcing the lever member into a first initial position where it abuts against the stop member.

In another embodiment, the lever member is constituted by a resiliently flexible tube member for the supply of cleaning agent to the jet nozzle member mounted on one end of the tube member, whereby the other end of the tube member is stationary fixed. Particularly, the lever member is constituted by a tube assembly comprising a flexible hose member for the supply of the cleaning agent and a spring member operatively connected to the flexible hose member, whereby the spring member, being in its no-load condition, determines a first initial position of the lever member. Preferably, the flexible hose member is surrounded, at least along a portion of its longitudinal extension, by a coil spring member.

In a further embodiment of the rinsing assembly, the longitudinal axis of the jet nozzle is inclined in a first direction by a first acute angle with regard to the central axis of the container to be cleaned when the lever member is in its first initial position, and in a second direction by a second acute angle when the lever member is in its second final position, whereby the first and second acute angles are essentially equal.

According to a third aspect, the invention further provides an apparatus for cleaning containers having an opening, particularly bottles, by spraying out and/or blowing out the interior of the containers by means of a jet of a fluid and/or gaseous cleaning agent. The apparatus comprises a conveyor for conveying the containers along a path of motion, means for arranging the containers on said conveyor in a row with uniform spatial orientation, and a rinsing assembly comprising a plurality of jet nozzles arranged in a row, the path of motion of the conveyor extending along the front of the plurality of jet nozzles.

Each of the jet nozzles of the row of jet nozzles is movably mounted independently of each other and each of the jet nozzles comprises means to be operated by the containers when the containers are conveyed along said path of motion to positively align each of the jet nozzle to the opening of the corresponding container during a portion of the path of motion of the containers to be cleaned.

Particularly, the apparatus comprises a plurality of jet nozzles mounted to be movable from a first initial position to a second final position and back to the first initial position, and connected to a supply of cleaning agent. The path of motion of each of the jet nozzles from the first initial position to the second final position and back to the first initial position extends along the path of motion of the containers to be cleaned. Each of the jet nozzles is relatively movable with regard to the motion of the containers, and each of the jet nozzles is provided with catch means adapted to come into engagement with a portion of the containers during their movement along their path of motion and thereby positively aligning the jet of cleaning fluid escaping from the corresponding jet nozzle with the opening of the containers during a portion of the path of motion of the containers.

In a further embodiment of the apparatus, the containers to be cleaned have a mutual distance when they are conveyed along said path of motion and the jet nozzles mounted in a movable position have a mutual distance, the mutual distance of the containers essentially corresponding to the mutual distance of the jet nozzles.

The row of containers and the row of jet nozzles can be shifted in phase with regard to each other such that the above mentioned means for aligning the jet nozzles to the bottle openings are engaged also if the containers have a lagging motion.

Preferably, the conveying means is a drag chain conveyor.

The advantage of a cleaning apparatus according to the invention comprising a row of jet nozzle which have a stationary position may be seen in the fact that the arrangement of the jet nozzles is not bound to a predetermined or given rhythm of motion of the containers to be cleaned. Thus, simpler conveyor means can be provided than in an apparatus known in the art which has jet nozzles moved in synchronization with the conveyor means for the containers to be cleaned. Furthermore, additional feeding and discharging means including specially designed grippers are not required. Particularly, the conveyor means can comprise a drag chain conveyor in which the containers to be conveyed have only a more or less regular mutual distance. The degree of the deviation of the mutual distance of the containers from a required distance can be easily influenced by choosing suitable gripper of simple design.

Finally, it must be pointed out that the rinsing assembly of the cleaning apparatus of the invention is not subjected to the spatial limitations which are typical for the cleaning apparatuses known in the art in which the jet nozzles are synchronously moved with the containers. In contrary, in the apparatus of the invention, the rinsing assembly may extend, if desired, practically along the entire length of the conveyor means, except a small portion for the dripping of the containers. Thereby, the row of the jet nozzles can be arranged past a curved portion of the conveyor means as well as past a linear portion thereof.

The goal to be achieved with a cleaning apparatus of the kind discussed herein generally is, on the one hand, to ensure a turnover of containers to be cleaned as high as possible by conveying the containers in a close sequence with a high conveying speed and, on the other hand, to keep the space required by the cleaning apparatus as small as possible. The turnover is determined essentially by the operating cycle of each jet nozzle, as will be further explained herein after. Independently thereof, the space requirements of the cleaning apparatus along the conveying path may be reduced to a minimum if the jet nozzles are arranged immediately one behind the other one in regular mutual distances whereby the region of operation of each jet nozzle is separated from the region of operation of the adjacent jet nozzles only by a small security distance. Thereby, each container to be cleaned immediately arrives from the region of operation of one jet nozzle to the region of operation of the subsequent jet nozzle with the result that the container to be cleaned is exposed nearly uninterruptedly by the jet of cleaning agent. Under these circumstances, the mutual distance of the jet nozzle may be even smaller than the mean mutual distance of the conveyed containers which is the most favorable one for the operation of the jet nozzle. The length of the rinsing assembly and, thereby, the one of the entire cleaning apparatus may thus be further reduced.

BRIEF DESCRIPTION OF THE DRAWINGS

In the following, the invention will be further described, with reference to the accompanying drawings, in which some embodiments of an apparatus are shown for the cleaning of bottles by rinsing them by means of a cleaning fluid. In particular, in the drawings.

DETAILED DESCRIPTION OF SOME PREFERRED EMBODIMENTS

Figures 1A, 1B, 1C, 1D, 1E, 1F, 1G:
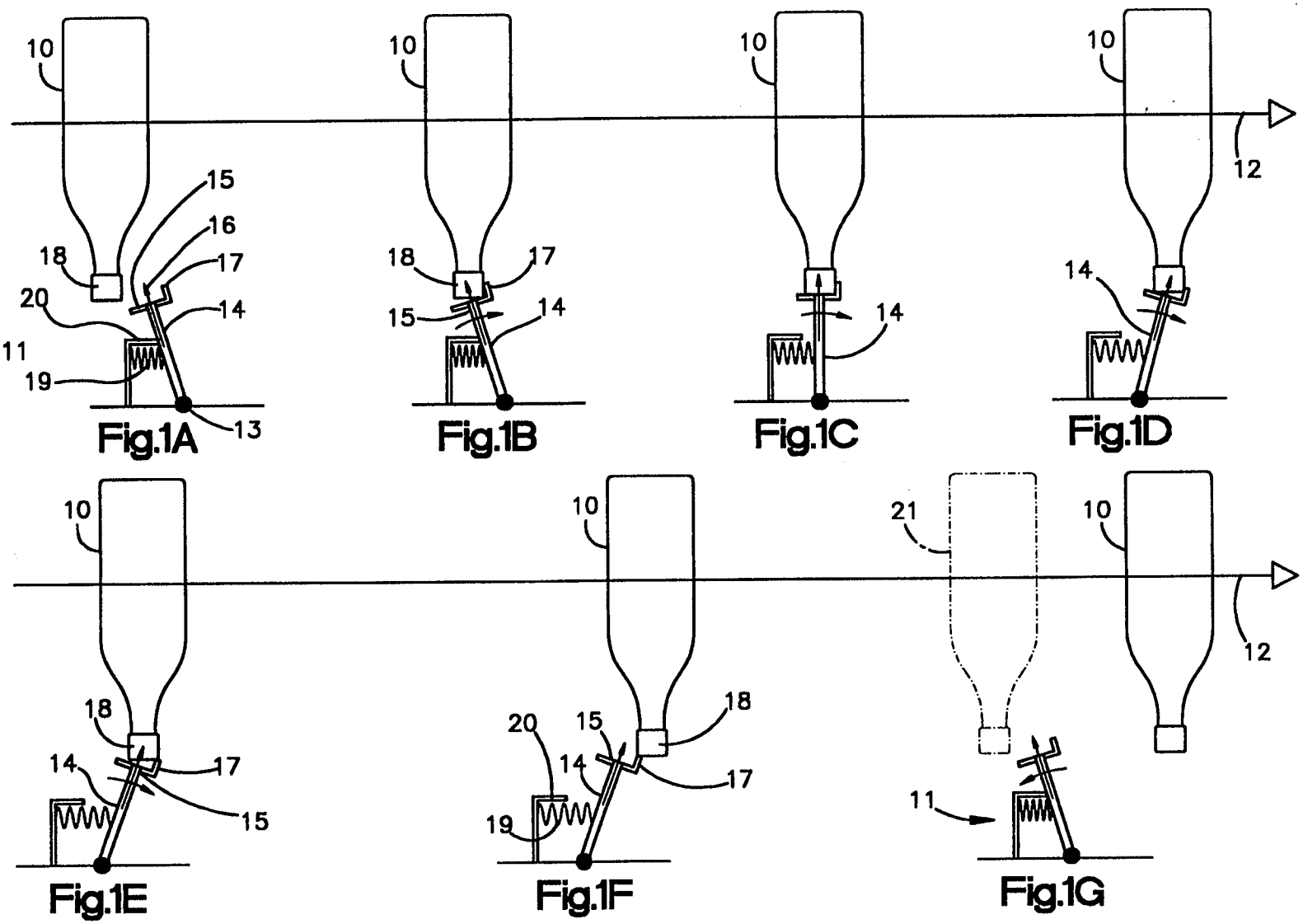
FIG. 1 shows a diagrammatic view of seven different phases of motion (1) to (7) of a jet nozzle mounted to a rigid pivotal lever.

In FIG. 1, there is diagrammatically shown an evenly and continuously conveyed bottle 10, having the bottle mouth directed to the bottom, in cooperation with a stationary, but movably mounted rinsing means 11 for rinsing the bottle 10. Thereby, seven different phases of operation labeled (1) to (7). The direction of the motion of the bottle 10 is indicated by the arrow 12. The rinsing means 11 comprises a lever 14 which is swiveling about a pivot 13. The lever 14 is designed as a tube member for the supply of a cleaning fluid whereby the end of the tube located at the free end of the lever 14 constitutes a jet nozzle 15, the cleaning fluid escaping from said jet nozzle 15 as a jet in the direction of the arrow 16. Furthermore, the free end of the lever 14 is provided with a catch means 17 cooperating with the head 18 of the bottle 10 surrounding the mouth of the bottle 10. Close to the swiveling lever 14, there is provided a stop member 20, and further provided is a spring member 19, one end thereof being connected to the stop member 20 and the other end thereof being connected to the swiveling lever 14 to keep the lever 14 in a position biased towards the stop member 20.

In the phase of motion (1), the bottle 10 approaches the rinsing means 11. The lever 14 abuts against the stop member 20 and the direction 16 of the cleaning fluid jet still is past the bottle 10. In the phase of motion (2), the mouth of the bottle 10 reaches a position where it is in front of the jet nozzle 15. The head 18 of the bottle 10 engages the catch means 17 of the rinsing means 11 and thereby continuously swivels the lever 14 around the pivot 13 against the force of the spring 19 in clockwise direction until the lever 14 is in its position shown in the phase of motion (5). Starting with the phase of motion (2) and ending with the phase of motion (5), the jet nozzle 15 at the free end of the lever 14 follows the mouth of the bottle 10. Thereby, the interior of the bottle 10 is rinsed by means of the jet of cleaning fluid escaping from the jet nozzle 15 whereby the direction of the escaping jet, as seen with regard to the central axis of the bottle 10, continuously changes.

At the transition from the phase of motion (5) to the phase of motion (6), the head 18 of the bottle 10 slides over the protruding end portion of the catch means 17 with the result that the jet nozzle 15, with unchanged position of the lever 14, moves away from the mouth of the bottle 10. As soon as the head 18 of the bottle 10 fully disengages the catch means 17, the lever 14 rapidly swivels back to its initial position towards the stop member 20 under the influence of the tensioned spring 19, as can be seen in the phase of motion (7). Thus, the rinsing means 11 is back in its initial position and ready for a further operation started by its engagement with the following bottle 21 approaching the rinsing means 11.

The cleaning fluid can be fed to the rinsing means 11 either via a articulation at the pivot 13 or via a flexible connecting tube which is laterally connected to the tube constituted by the lever 14. For the reason of clarity, such feeding of the cleaning fluid is not shown in FIG. 1.

Figures 2A, 2B, 2C, 2D, 2E, 2F, 2G:
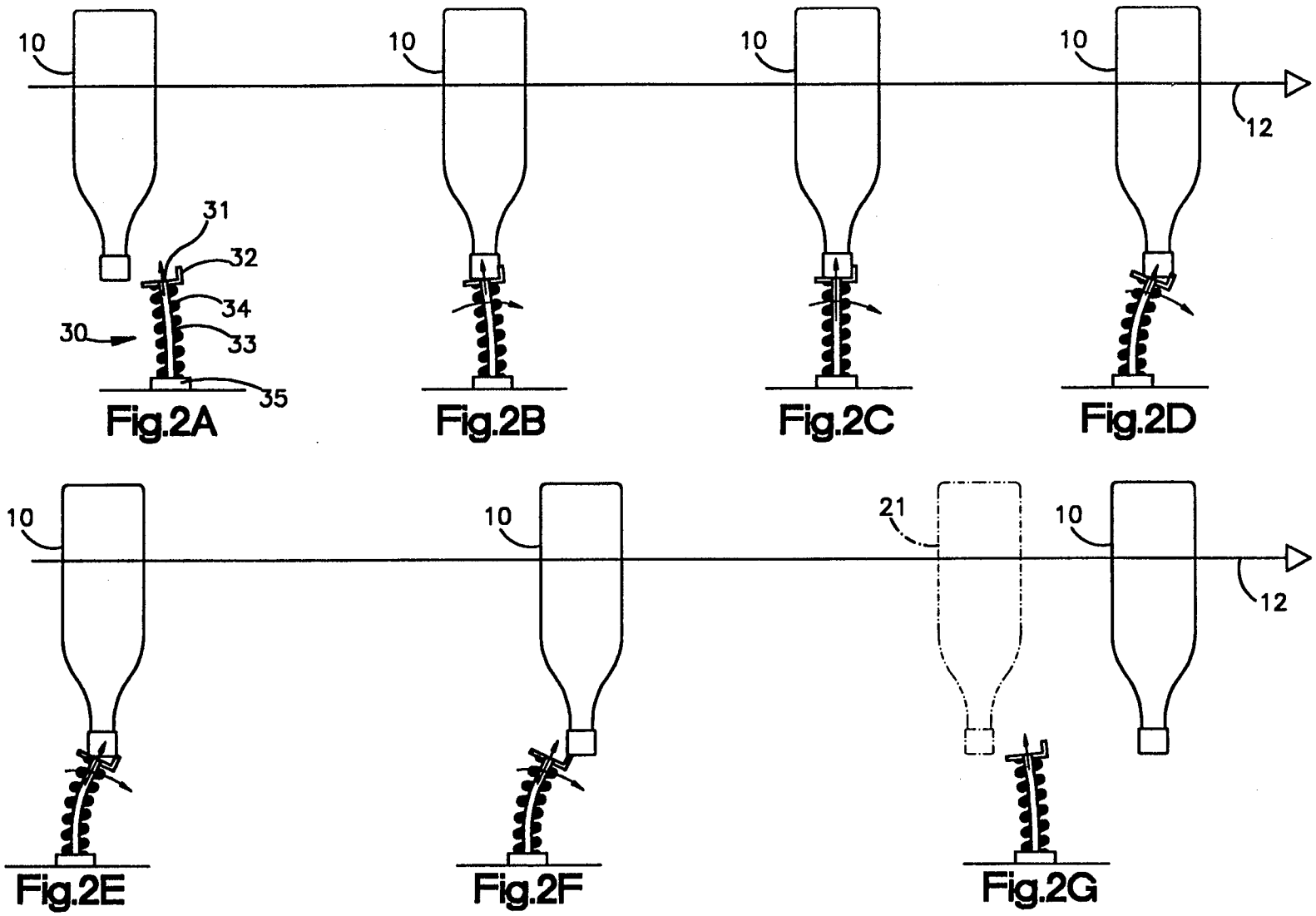
FIG. 2 shows a diagrammatic view of seven different phases of motion (1) to (7) of a jet nozzle mounted to a flexible pivotal lever.

A solution which is more favorable as far as the feeding of the cleaning fluid is concerned is diagrammatically shown in FIG. 2. In this embodiment, the rinsing means 30 comprises a flexible lever bearing the jet nozzle 31 and the catch means 32. The flexible lever is constituted by a flexible tube 33 for feeding cleaning fluid to the jet nozzle 31 which is surrounded by a coil spring 34. The coil spring 34 is made to have a curved shape under no-load conditions, thereby defining the initial position of the rinsing means 11 shown in phase of motion (1) in FIG. 2. The lower ends of the tube 33 and of the coil spring 34 are rigidly connected to a stationary connecting member 35 to which is connected a stationary supply pipe (not shown in FIG. 2) for the feeding of cleaning fluid to the jet nozzles 31. It is understood that the coil spring 34 shown in FIG. 2 could be replaced by a leaf spring (not shown in FIG. 2) suitably connected to the tube 33.

FIG. 2 shows the same phases of motion (1) to (7) as FIG. 1 does. As can be seen from FIG. 2, in fact, there is no essential difference as far as the operation of the cleaning means 30 is concerned. However, the course of motion is somewhat different from the one shown in FIG. 1. For instance, the conveying speed of the bottles 10 being the same as in FIG. 1, shorter periods of time between the phases of motion (2) and (5) result since the bending of the tube 33, as compared to the swiveling of the rigid lever 14 of FIG. 1, effects an additional swiveling motion of the catch means 32. Thus, the effective operating period of the cleaning jet is accordingly shorter. Further, in presetting the chronological sequence of the bottles, it has to be considered that the cleaning means 30 does not have a stop member (e.g. as the one designated by reference numeral 20 in FIG. 1) and therefor will perform an oscillating movement when it returns to its original position, except if particular dampening means are provided.

Figure 3A:
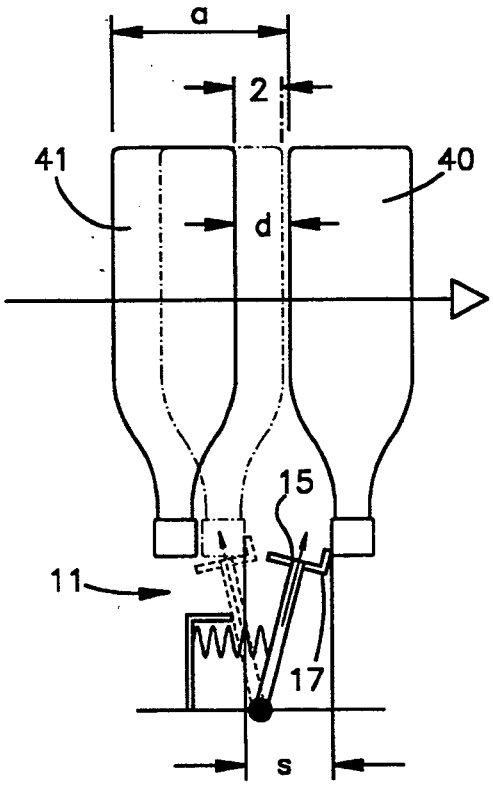
FIG. 3 shows diagrammatic views A to C for the explanation of the relation between the distance of the conveyed bottles and the path of motion of the jet nozzle.
Figure 3B:
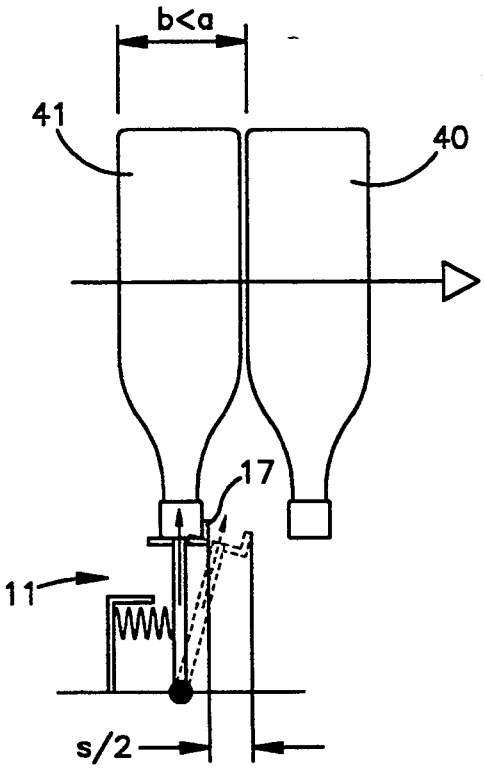
Figure 3C:
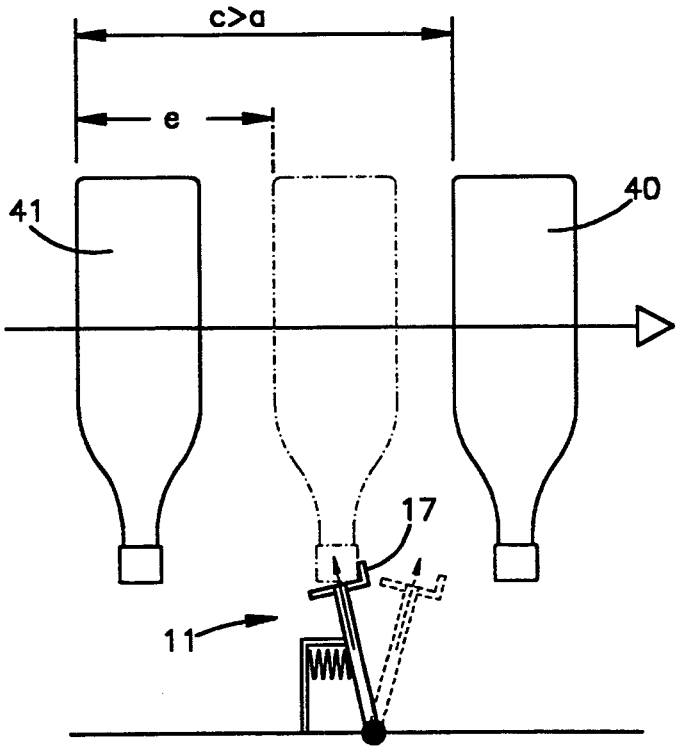

In order to optimize the operational results obtained with a rinsing means of the kind as diagrammatically shown as 11 in FIG. 1 and as 30 in FIG. 2, it is recommended that a mutual adaptation of the chronological sequences is performed, on the one hand of the sequence in which the bottles are moved past the jet nozzles, and on the other hand of the operation cycle of the rinsing means. Particularly, this relates to the conveying speed and the mutual distance of the bottles on the one hand, and to the path of operation of the movable jet nozzle and to the speed the latter one is moved back to its initial position on the other hand. These relationships are further explained with reference to FIG. 3 in which, as an example, the rinsing means 11 according to FIG. 1 is used. As can be seen from the drawing, three possible variations A, B and C are shown, each with two bottles 40 and 41 which are moved past the rinsing means 11 in different mutual distances a, b and c.

Generally, a mode of operation according to variation A is recommended. Here, the bottle 41 engages the catch means 17 of the jet nozzle 15 just in that moment in which the catch means 17, after a preceding phase in which it has followed the path of the bottle 40, i.e. after disengaging from the preceding bottle 40 (shown in continuous lines), has just finished its backward motion, i.e. has reached its initial position (shown in dashed lines). For this purpose, the bottles 40 and 41 must have a certain mutual distance a which is given by the path s corresponding to the distance between the initial position and the final position of the catch means 17, —this path s is covered simultaneously by the bottle 40 and the jet nozzle 15 with a certain conveying speed —, plus an additional path z which corresponds to the distance covered by the bottle 41 in a period which is needed by the catch means 17 to move back from its final position to its initial position. Therefrom, it results that the maximal conveying speed of the bottles essentially depends only of the maximally realizable speed of the jet nozzle with which it is moved from its final position to its initial position.

If the bottles 40, 41 follow each other in a shorter mutual distance as shown in variation B (distance $b<a$), the bottle 41 engages the catch means 17 of the jet nozzle 15 and thereby initiates a phase in which the jet nozzle 15 moves together with the bottle 41 before the catch means 17 has been able to reach its initial position, because it was swiveled in a preceding phase by engaging with the bottle 40. In the example shown (variation B in FIG. 3) the catch means 17 abuts against the head of the bottle 41 when it has covered only half of its path back to its initial position, i.e. a path s/2. The result is a corresponding shortening of the effective operation period of the jet nozzle during each of its subsequent operation cycles. In another example, illustrated as variant C in FIG. 3, in which the bottles 40, 41 have a greater mutual distance than in the ideal variation A (distance $c>a$), the contrary happens: Between the individual effective operating cycles of the jet nozzle an unnecessary and needless interrupt occurs. In other words, when the catch means 17 already has reached its initial position, the subsequent bottle 41 still has to cover the distance e until it reaches the catch means 17 for engaging the latter one and for initiating its cleaning. During this needless interrupt, cleaning fluid is spent to no avail.

However, the above mentioned circumstances allow that the mutual distance between the bottles or containers to be cleaned may vary within certain limits with regard to the above mentioned optimal value a without the danger that the resulting advantages vis-e,gra/a/-vis the known solution with stationary fixed jet nozzles be essentially decreased. Under certain circumstances, in setting the mutual distance a between the bottles to be cleaned, also the relation between the diameter of the bottle mouth and the bottle body has to be considered, particularly if the direct mutual distance d of the bottles should not to fall short of a minimal value. Corresponding considerations are also true for other containers to be cleaned.

Figure 4:
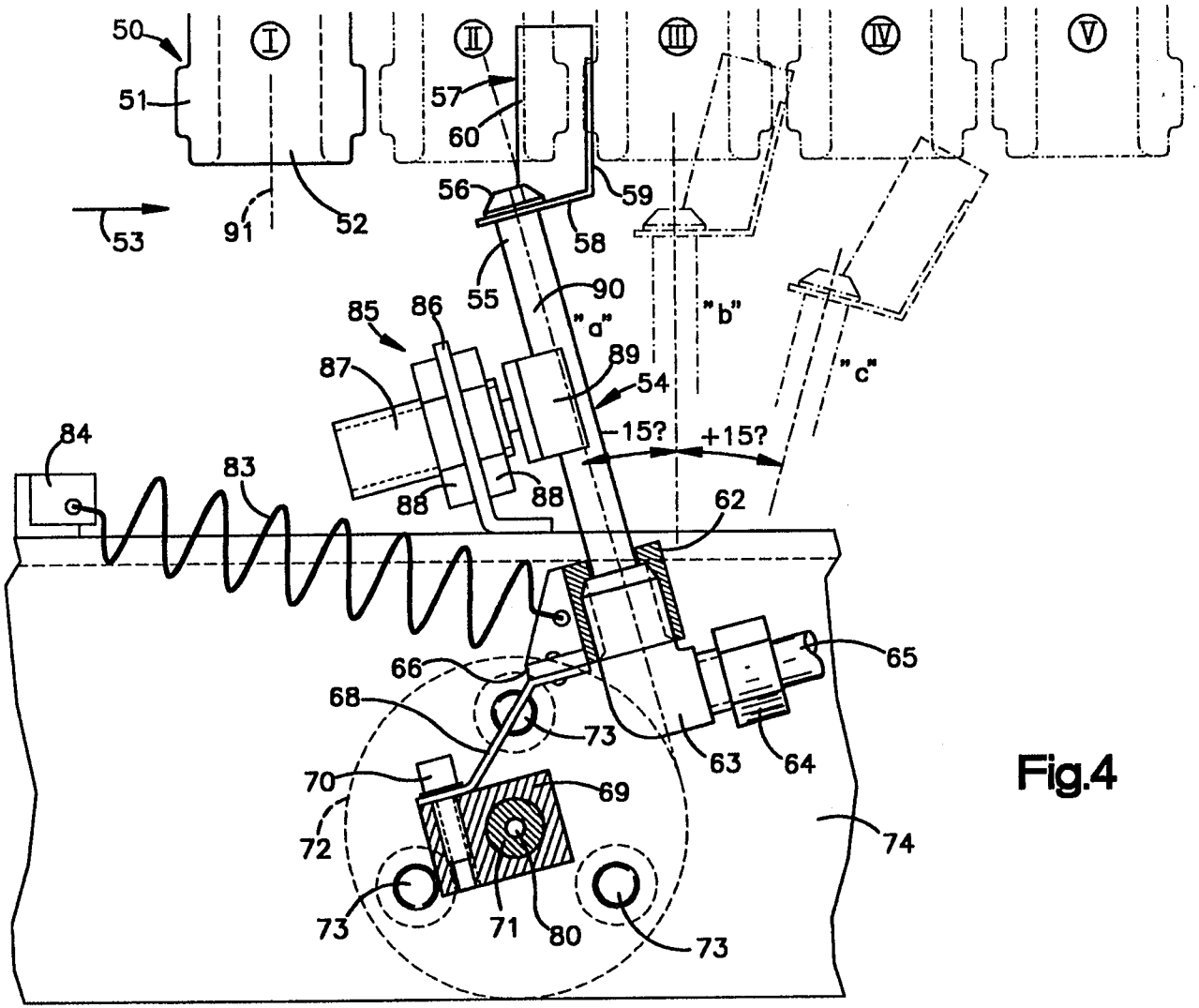
FIG. 4 shows a partially sectioned front view of a practical embodiment of the apparatus of the invention.
Figure 5:
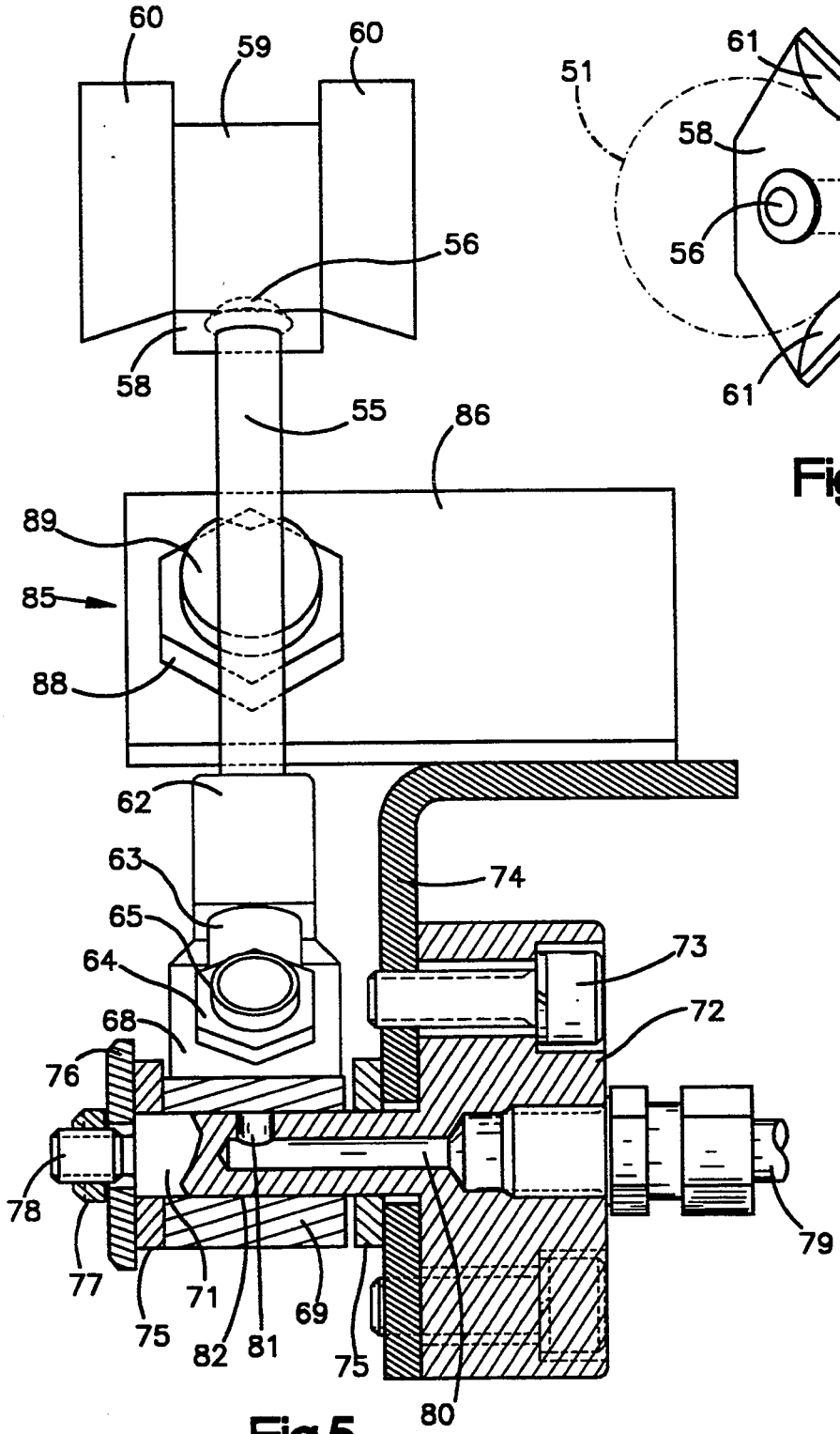
FIG. 5 shows a partially sectioned side view of the apparatus of FIG. 5.
Figure 6:
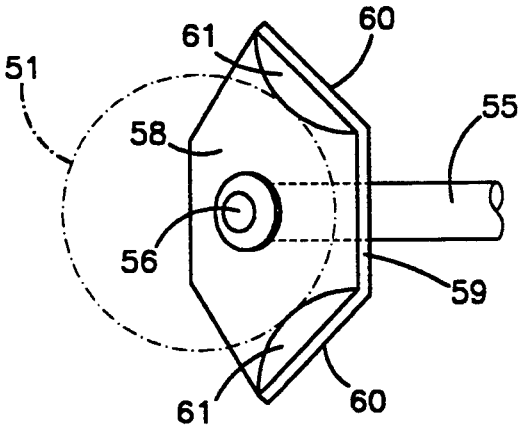
FIG. 6 shows a top view of the catch member of the apparatus according to FIGS. 5 and 6.

A practical embodiment of the apparatus of the invention is shown in FIGS. 4 to 6. In the upper part of FIG. 4, there can be seen the head 51 with the mouth 52 of a bottle 50 which is evenly and continuously conveyed in the direction of the arrow 53 and, thereby, runs through the phases (I) to (V) indicated in FIG. 4.

The rinsing means, generally designated with reference numeral 54, comprises a swiveling tube 55 with a jet nozzle 56 located at its free end. In the region of the jet nozzle 56, the tube 55 is provided with a catch member 57 which is constituted by a mounting leg 58 and a catch leg 59 protruding upwardly from the mounting leg and including an angle therewith. The catch leg 59 is provided with two lateral wing members 60 which enclose an angle of, for instance, 45° with a plane laid through the axis of the axis of the jet nozzle 56 and running in the conveying direction of the bottles 50. The two surfaces of the lateral wing members 60 facing each other are provided with cushion means 61 for dampening the shock occurring when the catch member 57 contacts the bottle head 51 (cf. FIG. 6).

The lower end of the tube 55 is received in a connector 62 and is fixed therein by means of a pipe elbow piece 63 screwed into the connector 62. Fixed to the pipe elbow piece 63, by means of an union nut 64, is a hose 65 by means of which the cleaning fluid is fed to the rinsing means 54. The connector 62 is provided with a connecting member 66 reinforced by a land member 67. A cranked leaf spring 68 is connected, with its one end, to the connecting member 66 of the connector 62 by means of a rivet and, with its other end, to a hub 69 by means of a screw 70.

The hub 69 is pivotally connected to a stationary shaft 71 which shaft 71 determines the position of the rinsing means 54. The shaft 71 is part of a bearing head 72 and is integrally formed therewith. The bearing head 72 is connected to a mounting rail 74 having an L-shaped cross-section by means of three screws 73. Two washers 75 serve to secure the hub 69 with axial clearance between the mounting rail 74 and an end washer 76, the latter one being secured to the shaft 71 by means of a nut 77 screwed onto the threaded end portion 78 of the shaft 71. In order to provide for a trouble-free operation of the rinsing means 54 which is pivotal around the shaft 71, lubrication means are provided feeding an externally available lubricant to the bearing surfaces.

For this purpose, a lubricant pipe 79 is connected to the center of the bearing head 72 through which a lubricant is fed, preferably periodically. The lubricant pipe 79 merges into an axially extending channel 80; a radially extending bore 81 leads from the above mentioned channel 80 to the cylindrical bearing surface 82.

The swiveling rinsing means 54 is held in a rest or initial position, as shown in FIG. 4. For this purpose, there is provided a tension spring 83, one end thereof being connected to the land member 67 of the connector 62 and the other end thereof being connected to a supporting member 84 fixedly anchored to the mounting rail 74. The rest or initial position is defined by a stop member, generally designated with reference numeral 85; thereby, the rinsing means 54 is pulled towards the said stop member 85 by means of the spring 83. The stop member 85 is fixed to a sheet metal support member 86 welded to the mounting rail 74 and consists of a cylindrical supporting member 87 having an externally threaded surface. The supporting member 87 is fixed to the sheet metal support member 86 in an axially adjustable position by means of two nuts 88. Furthermore, the stop member 85 is equipped with a cushioned shock absorber member 89 acting as a stop buffer.

According to FIG. 4, the rinsing means 54 is shown in three different pivotal positions: In the rest or initial position marked "a" (shown in solid lines), in an intermediate position marked "b" and in a final position marked "c" (both shown in dash-dot lines). Thereby, the design is such that the longitudinal axis 90 of the jet nozzle 56 and of the tube 56, respectively, in the rest position of the catch member 57 in the one direction and in the final position of the catch member 57 in the other direction is inclined with regard to the central longitudinal axis 91 of the mouth 52 of the bottle 50 running past the jet nozzle 56 by an acute inlet angle and an acute outlet angle, respectively. Preferably, the said inlet and outlet angles have essentially the same value, in the present example approximately 15°.

Figure 7:
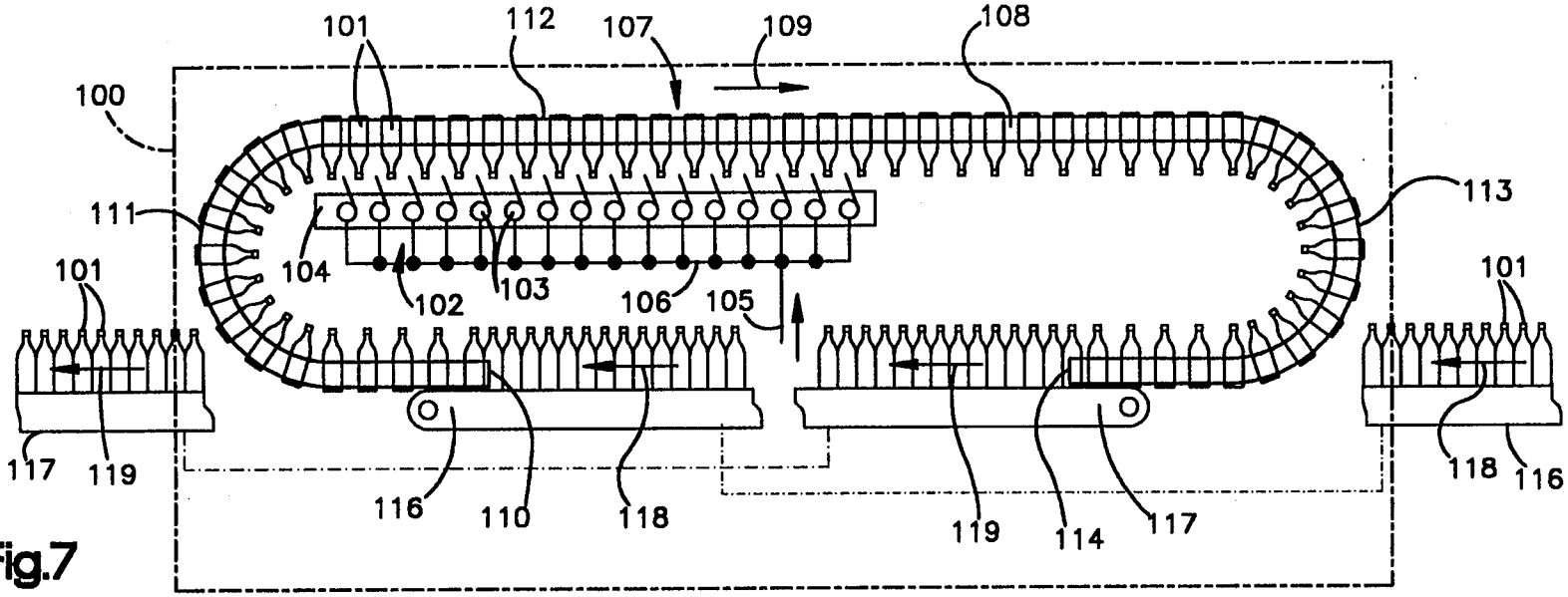
FIGS. 7 and 8 show a diagrammatic side view and a diagrammatic top view, respectively, of an apparatus for the cleaning of glass bottles, incorporating the rinsing means shown in FIGS. 4 to 6.
Figure 8:
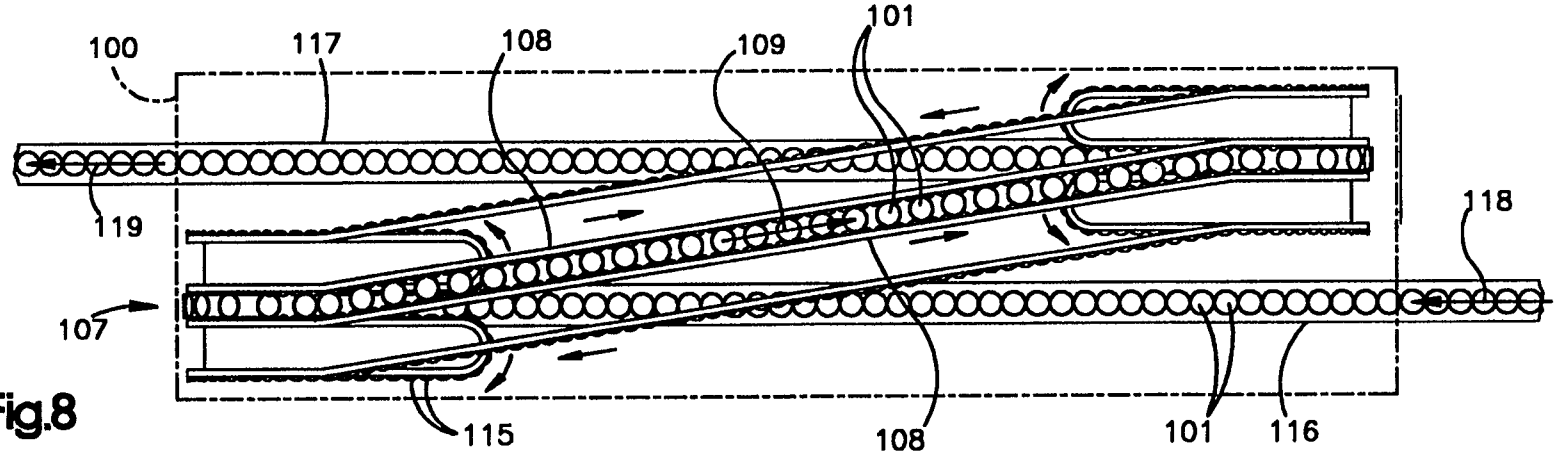

As can be seen from FIGS. 7 and 8, there is diagrammatically shown an apparatus 100 for cleaning bottles 101 by rinsing them by means of a cleaning fluid. The apparatus shown in these figures comprises a rinsing assembly with a plurality of rinsing means 103, each incorporating jet nozzles which are movable independently from each other of the type shown in and described with reference to FIGS. 4 to 6. These rinsing means 103 have a stationary position and are fixed to a mounting rail 104 in regular intervals. (cf. FIG. 7). The supply of the cleaning fluid to the rinsing means 103 is accomplished by means of a supply tube 105 and a common distributor tube 106. The apparatus 100 incorporates a conveying means in the form of a drag chain conveyor 107 known per se in the art which conveys the bottles 101 in a row through the sphere of activity of the rinsing means 102.

The drag chain conveyor 107 comprises two continuously running conveying chains 108 which extend along the conveying path in a certain distance from each other and move in the same direction, indicated by the arrow 109. The conveying path of the drag chain conveyor 107 extends in the form of a vertical slope, starting from an feeding portion 110 along a curved portion 111 upwards, then along a linear portion 112 further in a direction opposite to the feeding direction and finally in a second curved portion 113 downwards to a discharging portion 114 (cf. FIG. 7). The driving and guiding means for the chains 108 are not shown in the drawings sine this technology is well known in the art; the direction of motion of the chains 108 is shown in FIG. 8 by means of small arrows.

Connected to the conveying chains 108 are catch members 115 arranged along a row. Between the two conveying chains 108, there is provided a conveying channel intended to receive the bottles 101 to be conveyed; the conveying channel is laterally delimited by the two rows of the above mentioned catch members 115 facing each other. Adjoining to the feeding portion 110 and to the discharging portion 114 of the drag chain conveyor 107, there are provided further conveying means, for instance belt conveyors 116 and 117, for feeding and discharging bottles 101 in the directions indicated by the arrows 118 and 119, respectively.

Die curved portions 111 and 113, respectively, of the conveying path of the drag chain conveyer 107 are laterally offset with regard to each other, as can be seen in FIG. 8, with the result that the linearly extending portion 112 thereof extends in an oblique direction. Due to this design, the belt conveyors 116 and 117 can be linearly aligned with respect to the feeding portion 110 and the discharging portion 114, respectively, of the drag chain conveyor 107. For the handing over of the bottles 101 from the belt conveyor 116 to the drag chain conveyor 107 and from the latter one to the belt conveyor 117 no separate means have to be provided, i.e. there is no need for the provision of individually adapted form part members.

The bottles 101 to be cleaned are conveyed by means of the belt conveyor 116 in an upright position an one directly behind the other one to the feeding portion 110 of the drag chain conveyor 107 and are handed over to that conveyor. The conveying speed of the drag chain conveyor 107 is somewhat higher than the one of the belt conveyor 116 such that the bottles gripped by the drag chain conveyor 107 have a certain mutual distance. Along the upper linear portion 112, the bottles 101 are transported along the rinsing assembly 102 with the bottle mouth downwards, whereby each of the bottles one after the other operates all of the rinsing means 103. Thereby, the associated jet nozzles positively follow the motion of the bottles 101 and consequently are phase wisely aligned with the bottle mouths in order to enable the cleaning fluid jet to reach the interior of the bottles 101.

In the embodiment shown in FIG. 7, the rinsing means 102 extends over a portion of the length of the linearly extending path portion 112 of the drag chain conveyor 107. The drip off or draining of the cleaned bottles also takes place along a portion of the motion path of the drag chain conveyor along which the bottles are conveyed with the bottle mouth directed downwards. For this purpose, either the portion of the conveying path 112 adjoining to the rinsing means 102 can be used, or the conveying path of the drag chain conveyor may comprise a second slope, extending parallel to the one shown in FIG. 7. Under certain circumstances, the rinsing means 102 can be shorter and/or displaced towards the curved portion 111 in order to provide for enough free space along the linear portion 112 for a drip off or draining station and a drying station. Generally speaking, it is possible to provide for rinsing stations and/or drip off or draining stations and/or drying stations along the entire length of the conveying path of the drag chain conveyor 107; however, first and foremost, for the drip off or draining station, a conveying path portion has to be chosen in which the bottles are conveyed with its mouth directed downwards.

Figure 9:
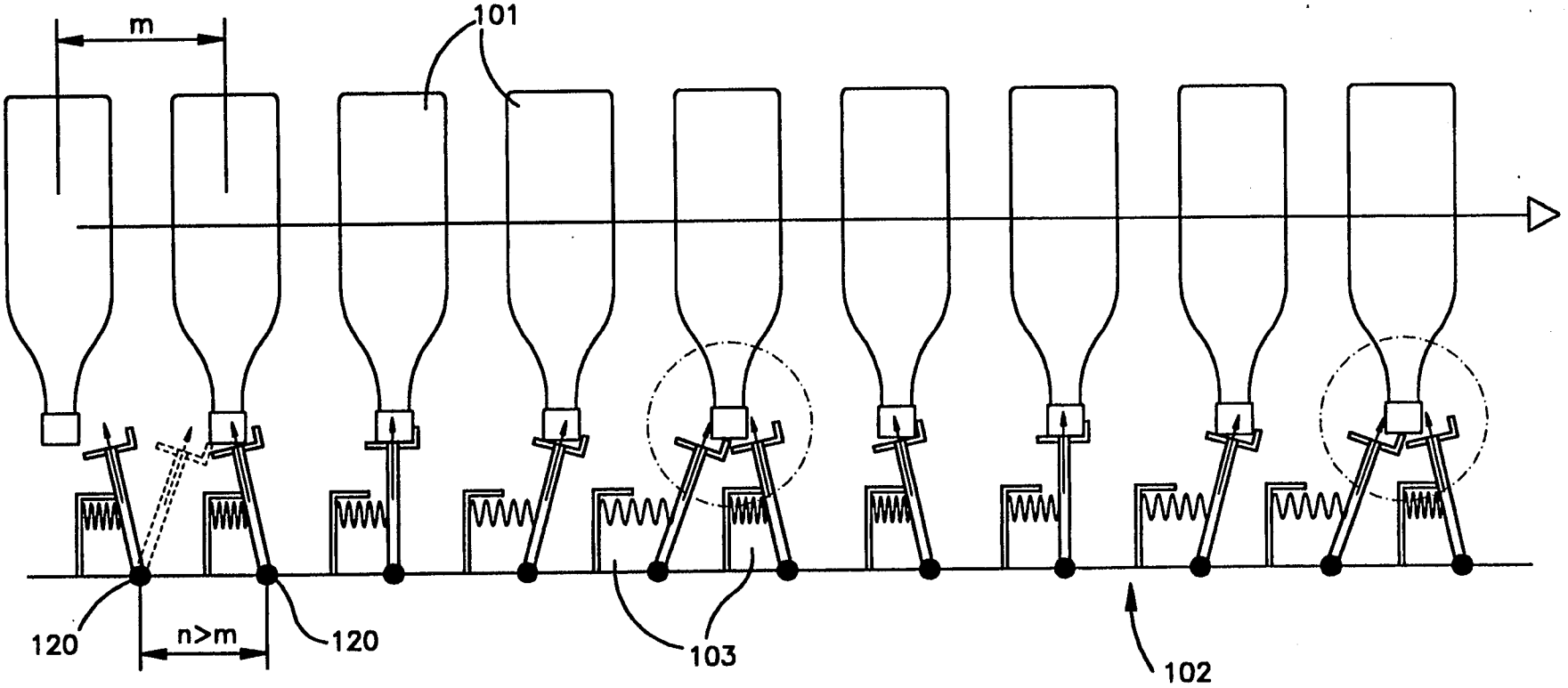
FIG. 9 shows a diagrammatic view for the explanation of the relation between the distance of the conveyed bottles and the mutual distance of adjacent jet nozzles of a plurality of jet nozzles regularly arranged in a row.

FIG. 9 diagrammatically shows a partial view of the rinsing assembly 102 according to FIG. 7 incorporating the plurality of rinsing means 103 arranged in a row and the plurality of bottles 101 running in a row past the rinsing means 103. The average mutual distance of the bottles 101 has the value m, and the positions 120 of the rinsing means 102 have a mutual distance n, which is just enough big that the movable parts of adjacent rinsing means 103 cannot touch each other. In this respect, the situations emphasized in the drawing by a dash-dot circle are critical, i.e. during the transition of a bottle 101 from one of the rinsing means 103 to the following one. As can be seen from FIG. 9, under suitable circumstances, the mutual n distance of the rinsing means 103 can even be smaller than the mutual distance m of the bottles.

The apparatus 130 for the cleaning of bottles diagrammatically shown in FIG. 9 is similarly designed as the one shown in FIGS. 7 and 8 as far as the means for conveying the bottles is concerned. Equal or similar parts and elements are designated with the same reference numerals in FIGS. 7 and 8 on the one hand and in FIG. 10 on the other hand.

Figure 10:
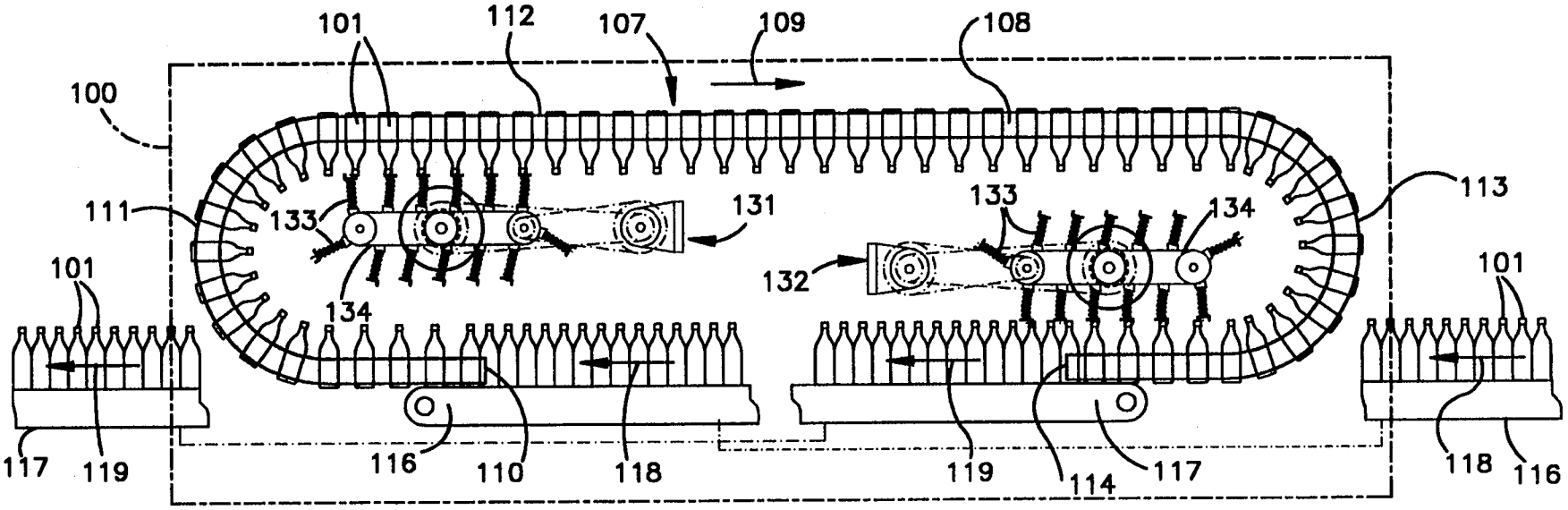
FIG. 10 shows a diagrammatic side view of an apparatus for the cleaning of glass bottles, similar to the one shown in FIG. 7, but incorporating two rinsing assemblies in which several jet nozzles are mounted on a movable support member.

In contrary to the embodiment shown in FIG. 7, the apparatus 130 according to FIG. 10 incorporates two rinsing assemblies 101 and 132 of identical design, each of the rinsing assemblies comprising a plurality of rinsing means 133 with movable jet nozzles which generally are designed as shown in and explained with regard to FIG. 2. In this case, however, the rinsing means 133 do not have a fixed position, but are mounted on a continuously movable supporting member 134.

Figure 11:
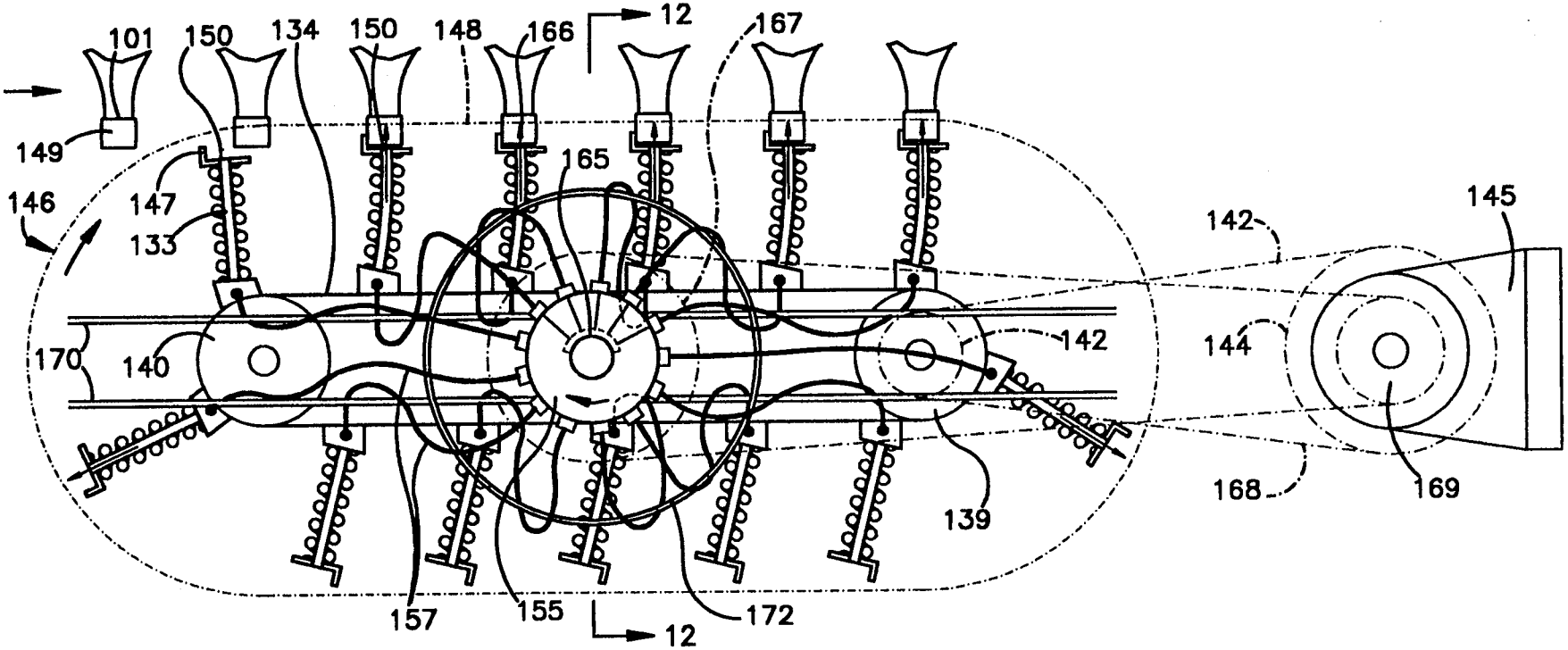
FIG. 11 shows an enlarged view of one of the rinsing assemblies shown in FIG. 10.
Figure 12:
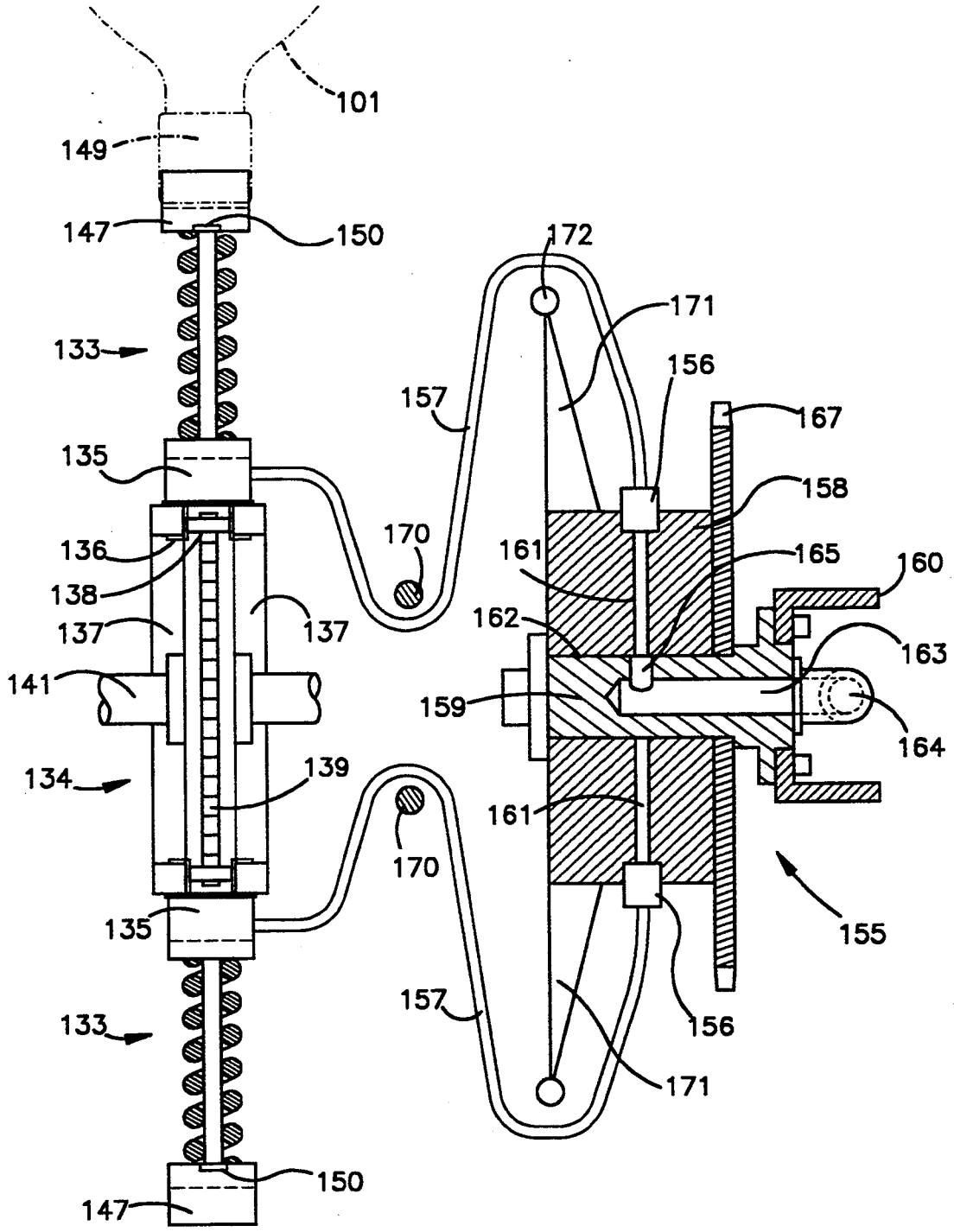
FIG. 12 shows a cross sectional view along line XII—XII of FIG. 11.

Further details of the rinsing assembly 131 can be seen in the enlarged view of FIG. 11 and in the even more enlarged sectional view of FIG. 12. Each rinsing means 133 comprises a connecting member 135 serving as a base and being fixed to a supporting member 136 which is slidably mounted in two closed loop glide rails 137. Each of the two rails 137 partially encloses each of the supporting menders 136. Each supporting member 136 is connected to a link of a driving chain 138 which is guided by means of two tail pulleys 139 and 140. The driving chain 128, the glide rails 137 which follow the path of the driving chain 138 and the supporting members 136 together form the continuously movable supporting member 134. Mounted to the shaft 141 of the tail pulley 139 is a sprocket wheel 142, not shown in FIG. 8, which is connected to the driving pinion 144 of a driving motor 145 by means of a driving chain 143.

The rinsing assembly 131 is located below the linear portion 112 of the drag chain conveyor 107 such that the path of motion 146 of the catch members 147 provided on the rinsing means 133 extends, along the linear upper conveying path portion 148, into the path of motion of the bottle head 149 of the bottles 101 which are conveyed by means of the drag chain conveyor 107 with their mouths downwards. The mutual distance of the rinsing means 133 corresponds to the average mutual distance of the conveyed bottles 101, and the speed to which the supporting member 134 of the rinsing means 133 is driven is approximately adapted to the conveying speed of the drag chain conveyor 107 in such a way that on each bottle 101 the jet nozzle 150 of a single rinsing means 133 takes effect.

In a rinsing means having a swiveling jet nozzle which is in a fixed position as has been discussed herein before with reference to e.g. FIGS. 1 and 2, the catch member inevitably abuts always against the leading side of the bottle head. In contrary thereto, in a design in which the jet nozzles are moving, the construction and mode of operation, as one chooses, that the catch member either abuts against the leading or to the lagging side of the bottle head. Preferably, in the first case, the speed to which the supporting member 134 is driven will be selected to be somewhat lower and, in the second case, somewhat higher than the conveying speed of the drag chain conveyor 107. The appropriate selection is made to ensure that all momentarily active jet nozzles positively follow the bottles which are in their operating range. On the other hand, in this manner it can be made sure that the jet nozzle is swiveled during its operational phase, similarly as explained in connection with the stationary rinsing means. In the present example as shown in FIGS. 9 to 11, the rinsing assembly 131 is provided with lagging catch members 147.

The supply of cleaning fluid to the jet nozzles 150 is realized with the help of a distribution wheel member 155 having, along its periphery, a plurality of connections 156 for the connection of flexible tubes 157 which lead to the connecting members 135 of the individual jet nozzles 150. The body 158 of the distribution wheel member 155 is rotatably mounted on a shaft 159 which, itself, is connected to a stationary mounting rail 160. The distribution wheel member body 158 is provided with radially extending channels 161 starting at the bearing bore 162 and leading to the individual peripheral connections 156. The shaft 159 comprises a central hollow chamber 163 to which is connected a stationary supply pipe 164. Furthermore, the shaft 159 is provided with an annular segment shaped peripheral groove 156 communicating with the aforementioned hollow chamber 163 and which covers the inner mouths of a certain number of the radially extending channels 161. Thereby, the supply of cleaning fluid is limited to those jet nozzles 150 which actually are just following respective bottles, marked with arrows 166 in FIG. 11. The body 158 of the distribution wheel member 155 is rigidly connected to a sprocket wheel 167; on the other side, the driving motor 145 comprises a further sprocket wheel 169, and the two sprocket wheels 167 and 169 are coupled with each other by means of a driving chain 168 in order to drive the distribution wheel member to a rotational movement.

A requirement for the trouble-free operation of the cleaning apparatus as described above is an exact match of the rotating speed of the distribution wheel member 155 and the speed to which the supporting members 134 are driven. This goal may be reached by suitably choosing the transmission ration of the driving :means for the distribution wheel member 155 on the one hand and for the supporting members 134 on the other hand. If these requirements are met, it can be ensured that the mean distance of the connections 156 on the distribution wheel member 155 from the connecting members 135 of the rinsing means 133 remains constant and varies between a certain maximal distance and a certain minimal distance.

Preferably, guiding means are provided for the flexible tubes 157 in order to prevent the flexible tubes 157 to get into a tangle. Such guiding means may comprise, for instance as shown in FIGS. 11 and 12, two parallel rods 170 located between the rinsing means 133 traveling on the supporting members 134 and the distribution wheel member 155, said rods 170 extending in the longitudinal direction of the rinsing assembly 131, and an annular member 172 connected to the distribution wheel member body 158 by means of spokes 171. Thereby, the diameter of the annular member 172 is considerably greater than the mutual distance of the two rods 170. Thanks to the provision of these guiding members, the flexible tubes 157, as soon as they approach the distribution wheel member 155, are guided inwardly under the influence of one of the rods 170 and outwardly under the influence of the annular member 172 such that they cannot hinder each other. In place of the rods 170, there may be provided continuously running closed-loop belts having linear portions of suitable length ore similar means. Thereby, the friction between the guiding means and the flexible tubes 157 inevitably occurring during the operation of the apparatus can be considerably reduced.

The catch members 147 have a considerably higher traveling speed along the curved portions of the path of motion 146 of the supporting members 134 than along the linear portions 148 thereof. Thus, under certain circumstances, it may be advantageous to delay the meeting of a catch member 147 with the corresponding bottle head 149 for such a period until the meeting parts have essentially the same traveling speed to ensure that the catch member gently hits the bottle head. Several different solutions are possible for temporary delaying the catch members. Particularly suitable are means which force the catch members 147 to run along a curved path with reduced radius, at least along the feeding portion; this may be accomplished by designing the rinsing means 133 flexible. For this purpose, a guiding strip may be provided in the feeding portion which bends the catch members 147 radially inwards until they have reached the linear portion 148 of the path of motion. Another possibility is to provide the catch members 147 with traction ropes having a fixed length which are fixed to the traveling connecting member 134 with a certain distance from the lower base point of the rinsing means 133. These traction ropes reduce the distance between the catch member 147 and the related anchoring point of the at the corresponding supporting member 134 along the curved portions of the path of motion due to the fact that the catch members 147 are radially pulled inwards along the curved portions of the path of motion, whereby the rinsing means 133 are flexibly bent.

The rinsing assembly 131 is located in front of a number of bottles 101 in an upside down position as is usual in a wet cleaning process. On the other hand, the rinsing assembly 132 is located above and in front of a number of upright standing bottles 101. This arrangement can be used for a dry-cleaning of the bottles, particularly for blowing-out the interior of the bottles, e.g. for a degermination of the bottles by blowing hot steam or ozone into the interior of the bottles. Furthermore, this arrangement can serve for providing the interior of the bottles, e.g. shortly before they are filled with a liquid, with a carbon dioxide atmosphere.

In the embodiment of the bottle cleaning apparatus 130 shown in FIGS. 10 to 12, the rinsing assemblies 131 and 132 are arranged such that the rows of jet nozzles travel in a vertical plane. However, it is also possible to choose a design in which the rows of jet nozzles travel in a horizontal plane. Furthermore, (not shown) means can be provided which render possible that the position of the rinsing assemblies can be adapted to different bottle sizes and shapes by vertically and/or horizontally displacing the rinsing assemblies.

In order to adapt the operation of the rinsing assemblies to the conveying speed and to the mutual distance of the bottles to be cleaned, each of the rinsing assemblies can be provided with a slaved control means incorporating sensor means for sensing the decisive values and incremental control means; particularly, a step motor can be used as the driving motor for the rinsing assemblies.

What is claimed is:

1. A rinsing assembly for cleaning containers having an opening, particularly bottles, which are conveyed with uniform speed along a path of motion extending in front of said rinsing assembly, by spraying out and/or blowing out the containers by means of a jet of a fluid and/or gaseous cleaning agent, comprising:

at least one jet nozzle mounted to be movable from a first initial position to a second final position and back to said first initial position, and connected to a supply of cleaning agent;

the path of motion of said at least one jet nozzle from said first initial position to said second final position and back to said first initial position extending along the path of motion of said containers to be cleaned;

said at least one jet nozzle being relatively movable with regard to the motion of said containers; and said at least one jet nozzle including catch means against which a portion of said containers engage during their movement with uniform speed along their path of motion to (i) positively align the jet of cleaning fluid escaping from said jet nozzle with the opening of said containers during movement of said containers and said jet nozzle along a portion of the path of motion of said containers, and (ii) clean said containers with the jet of cleaning fluid escaping from said jet nozzle during simultaneous movement of said containers and said jet nozzle along another portion of the path of motion of said containers.

2. A rinsing assembly according to claim 1 in which said at least one jet nozzle is mounted in a stationary position.

3. A rinsing assembly according to claim 1 in which said at least one jet nozzle is mounted in a movable position, said movable position running on a path extending parallel to the path of motion of said containers to be cleaned and with a speed which is adapted to the conveying speed of said containers.

4. A rinsing assembly according to claim 3 in which said at least one movable jet nozzle is provided with a catch member movable between said first initial position and said second final position whereby it protrudes into the path of motion of said containers during movement thereof from said first position to said second position.

5. A rinsing assembly according to claim 4 in which the path of motion of said catch member and the path of motion of said containers diverge.

6. A rinsing assembly according to claim 4 in which the longitudinal axis of said jet nozzle is inclined in a first direction by a first acute angle with regard to the central axis of the container to be cleaned when said lever member is in its first initial position, and in a second direction by a second acute angle when said lever member is in its second final position.

7. A rinsing assembly according to claim 6 in which said first and second acute angles are essentially equal.

8. A rinsing assembly according to claim 1 in which said at least one jet nozzle is mounted at the free end of a swiveling single arm lever member, whereby a spring means is provided to force said lever member into said first initial position, said lever member coming into engagement with a portion of a container conveyed along said jet nozzle to be forced to follow said container along a portion of its path of motion against the force of said spring means, said jet nozzle remaining in a position aligned with the opening of the relating container as said lever member is in engagement with said portion of said related container.

9. An apparatus for cleaning containers having an opening, particularly bottles, by spraying out and/or blowing out the interior of the containers by means of a jet of a fluid and/or gaseous cleaning agent, the apparatus comprising:

a conveyor means for conveying said containers with uniform speed along a path of motion;

means for arranging said containers on said conveyor means in a row with uniform spatial orientation;

a rinsing assembly comprising a plurality of jet nozzles arranged in a row, the path of motion of said conveying means extending along the front of said plurality of jet nozzles;

each of said jet nozzles of said row of jet nozzles being movably mounted independently of each other; and each of said jet nozzles comprising means to be operated by said containers when said containers are conveyed with uniform speed along the path of motion to (i) positively align each of said jet nozzles to the opening of the corresponding container during movement of the container and the jet nozzle along the path of motion of said containers, and (ii) clean the corresponding container with a jet of fluid and/or gaseous cleaning agent from the jet nozzle during simultaneous movement of the container and the jet nozzle along the path of motion of said containers.

10. An apparatus according to claim 9 in which there is provided a plurality of jet nozzles mounted to be movable from a first initial position to a second final position and back to said first initial position, and connected to a supply of cleaning agent;

the path of motion of each of said jet nozzles from said first initial position to said second final position and back to said first initial position extending along the path of motion of said containers to be cleaned;

each of said jet nozzles being relatively movable with regard to the motion of said containers; and each of said jet nozzles being provided with catch means adapted to come into engagement with a portion of said containers during their movement along their path of motion and thereby positively aligning the jet of cleaning fluid escaping from the corresponding jet nozzle with the opening of said containers during a portion of the path of motion of said containers.

11. An apparatus according to claim 11 in which said jet nozzles are mounted in a stationary position in regular mutual distances.

12. An apparatus according to claim 10 in which said jet nozzles are mounted in a movable position, said movable position running on a path extending parallel to the path of motion of said containers to be cleaned and with a speed which is adapted to the conveying speed of said containers.

13. An apparatus according to claim 12 in which each of said movable jet nozzles is provided with a catch member movable between said first initial position and said second final position whereby it protrudes into the path of motion of said containers during movement thereof from said first position to said second position.

14. An apparatus according to claim 13 in which the path of motion of said catch member and the path of motion of said containers diverge.

15. An apparatus according to claim 9 in which said containers to be cleaned have a mutual distance when said containers are conveyed along the path of motion and wherein said jet nozzles mounted in said movable position have a mutual distance, said mutual distance of said containers essentially corresponding to the mutual distance of said jet nozzles.

16. An apparatus according to claim 15 in which said row of containers and said row of jet nozzles are shifted in phase with regard to each other such that said means for aligning the jet nozzles to the bottle openings are engaged also if the containers have a lagging motion.

17. An apparatus according to claim 9 in which said conveying means is a drag chain conveyor.

18. A rinsing assembly for cleaning containers having an opening, particularly bottles, which are conveyed along a path of motion extending in front of said rinsing assembly, by spraying out and/or blowing out the containers by means of a jet of a fluid and/or gaseous cleaning agent, comprising:

at least one jet nozzle mounted to be movable from a first initial position to a second final position and back to said first initial position, and connected to a supply of cleaning agent;

the path of motion of said at least one jet nozzle from said first initial position to said second final position and back to said first initial position extending along the path of motion of said containers to be cleaned;

said at least one jet nozzle being relatively movable with regard to motion of said containers;

said at least one jet nozzle is provided with catch means adapted to come into engagement with a portion of said containers during their movement along their path of motion and thereby positively aligning the jet of cleaning fluid escaping from said jet nozzle with the opening of said containers during a portion of the path of motion of said containers;

said at least one jet nozzle is mounted at the free end of a swiveling single arm lever member, whereby a spring means is provided to force said lever member into said first initial position, said lever member coming into engagement with a portion of a container conveyed along said jet nozzle to be forced to follow said container along a portion of its path of motion against the force of said spring means, said jet nozzle remaining in a position aligned with the opening of the relating container as said lever member is in engagement with said portion of said related container; and said lever member is constituted by a rigid tube member, one end thereof being pivotally mounted and said tube member being adapted to supply cleaning agent to the jet nozzle mounted on its free end, said rinsing assembly further comprising a stop member and a spring means forcing said lever member into a first initial position where it abuts against said stop member.

19. A rinsing assembly for cleaning containers having an opening, particularly bottles, which are conveyed along a path of motion extending in front of said rinsing assembly, by spraying out and/or blowing out the containers by means of a jet of a fluid and/or gaseous cleaning agent, comprising:

at least one jet nozzle mounted to be movable from a first initial position to a second final position and back to said first initial position, and connected to a supply of cleaning agent;

the path of motion of said at least one jet nozzle from said first initial position to said second final position and back to said first initial position extending along the path of motion of said containers to be cleaned;

said at least one jet nozzle being relatively movable with regard to the motion of said containers;

said at least one jet nozzle is provided with catch means adapted to come into engagement with a portion of said containers during their movement along their path of motion and thereby positively aligning the jet of cleaning fluid escaping from said jet nozzle with the opening of said containers during a portion of the path of motion of said containers;

said at least one jet nozzle is mounted at the free end of a swiveling single arm lever member, whereby a spring means is provided to force said lever member into said first initial position, said lever member coming into engagement with a portion of a container conveyed along said jet nozzle to be forced to follow said container along a portion of its path of motion against the force of said spring means, said jet nozzle remaining in a position aligned with the opening of the relating container as said lever member is in engagement with said portion of said related container; and said lever member is constituted by a resiliently flexible tube member for the supply of cleaning agent to the nozzle member mounted on one end of said tube member, whereby the other end of said tube member is stationary fixed.

20. A rinsing assembly for cleaning containers having an opening, particularly bottles, which are conveyed along a path of motion extending in front of said rinsing assembly, by spraying out and/or blowing out the containers by means of a jet of a fluid and/or gaseous cleaning agent, comprising:

at least one jet nozzle mounted to be movable from a first initial position to a second final position and back to said first initial position, and connected to a supply of cleaning agent;

the path of motion of said at least one jet nozzle from said first initial position to said second final position and back to said first initial position extending along the path of motion of said containers to be cleaned;

said at least one jet nozzle being relatively movable with regard to the motion of said containers;

said at least one jet nozzle is provided with catch means adapted to come into engagement with a portion of said containers during their movement along their path of motion and thereby positively aligning the jet of cleaning fluid escaping from said jet nozzle with the opening of said containers during a portion of the path of motion of said containers;

said at least one jet nozzle is mounted at the free end of a swiveling single arm lever member, whereby a spring means is provided to force said lever member into said first initial position, said lever member coming into engagement with a portion of a container conveyed along said jet nozzle to be forced to follow said container along a portion of its path of motion against the force of said spring means, said jet nozzle remaining in a position aligned with the opening of the relating container as said lever member is in engagement with said portion of said related container; and said lever member is constituted by a tube assembly comprising a flexible hose member for the supply of the cleaning agent and a spring member operatively connected to said flexible hose member, whereby said spring member, being in its no-load condition, determines a first initial position of said lever member.

21. A rinsing assembly according to claim 20 in which said flexible hose member is surrounded, at least along a portion of its longitudinal extension, by a coil spring member.

22. A rinsing assembly according to claim 20 in which said flexible hose member is connected to a leaf spring member.

23. An apparatus according to claim 20 in which said flexible hose member is connected to a leaf spring member.

24. An apparatus for cleaning containers having an opening, particularly bottles, by spraying out and/or blowing out the interior of the containers by means of a jet of a fluid and/or gaseous cleaning agent, the apparatus comprising:

a conveyor means for conveying said containers along a path of motion;

means for arranging said containers on said conveyor means in a row with uniform spatial orientation;

a rinsing assembly comprising a plurality of jet nozzles arranged in a row, the path of motion of said conveying means extending along the front of said plurality of jet nozzles;

each of said jet nozzles of said row of jet nozzles being movably mounted independently of each other; and each of said jet nozzles comprising means to be operated by said containers when said containers are conveyed along the path of motion to positively align each of said jet nozzles to the opening of the corresponding container during a portion of the path of motion of said containers to be cleaned;

a plurality of jet nozzles mounted to be movable from a first initial position to a second final position and back to said first initial position, and connected to a supply of cleaning agent;

the path of motion of each of said jet nozzles from said first initial position to said second final position and back to said first initial position extending along the path of motion of said containers to be cleaned;

each of said jet nozzles being relatively movable with regard to the motion of said containers; and each of said jet nozzles being provided with catch means adapted to come into engagement with a portion of said containers during their movement along their path of motion and thereby positively aligning the jet of cleaning fluid escaping from the corresponding jet nozzle with the opening of said containers during a portion of the path of motion of said containers; and each of said jet nozzles is mounted at the free end of a swivelling single arm lever member, whereby a spring means is provided to force said lever member into said first initial position, said lever member coming into engagement with a portion of a container conveyed along a jet nozzle to be forced to follow said container along a portion of its path of motion against the force of said spring means, the corresponding jet nozzle remaining in a position aligned with the opening of the relating container as said lever member is in engagement with said portion of said related container.

25. An apparatus according to claim 24 in which said lever member is constituted by a rigid tube member, one end thereof being pivotally mounted and said tube member being adapted to supply cleaning agent to the jet nozzle mounted on its free end, said rinsing assembly further comprising a stop member and a spring means forcing said lever member into a first initial position where it abuts said stop member.

26. An apparatus according to claim 24 in which said lever member is constituted by a resiliently flexible tube member for the supply of cleaning agent to the jet nozzle member mounted on one end of said tube member, whereby the other end of said tube member is stationary fixed.

27. An apparatus according to claim 24 in which said lever member is constituted by a tube assembly comprising a flexible hose member for the supply of the cleaning agent and a spring member operatively connected to said flexible hose member, whereby said spring member, being in its no-load condition, determines a first initial position of said lever member.

28. An apparatus according to claim 27 in which said flexible hose member is surrounded, at least along a portion of its longitudinal extension, by a coil spring member.

* * * * *